United States Patent [19]

Chattopadhayay et al.

[11] 3,993,033

[45] Nov. 23, 1976

[54] FUEL QUANTITY DISTRIBUTOR FOR MULTICYLINDER COMBUSTION ENGINE

[76] Inventors: Asoke Chattopadhayay, Ulmenallee 134, 4041 Norf; Wolfgang Müller, Kleinsiepstr. 56, 4044 Kaarst, both of Germany

[22] Filed: Mar. 27, 1975

[21] Appl. No.: 562,451

[30] Foreign Application Priority Data

June 20, 1974 Germany ..... 2429716

[52] U.S. Cl. ..... 123/139 BC; 123/139 AL; 137/625.46

[51] Int. Cl.[2] ..... F02M 69/00

[58] Field of Search ..... 123/139 BC, 139 BE, 123/139 AL, 139 AM; 137/625.46

[56] References Cited

UNITED STATES PATENTS

| | | | |
|---|---|---|---|
| 2,624,326 | 1/1953 | Fiser | 123/139 BC |
| 2,633,187 | 3/1953 | Smith, Jr. | 123/139 BC |
| 2,750,933 | 6/1956 | Lauck | 123/139 BC |
| 2,895,464 | 7/1959 | Tennant et al. | 123/139 BC |
| 3,931,803 | 1/1976 | Chattopadhayay et al. | 123/139 R X |

FOREIGN PATENTS OR APPLICATIONS

| | | | |
|---|---|---|---|
| 569,602 | 2/1933 | Germany | 123/139 BC |

*Primary Examiner*—Charles J. Myhre
*Assistant Examiner*—Tony M. Argenbright
*Attorney, Agent, or Firm*—Haseltine, Lake & Waters

[57] ABSTRACT

A fuel quantity distributor for use in conjunction with multicylinder combustion engines, in which two concentric, radially adjacent metering elements have metering inlet channels. The metering elements are rotatable relative to one another, and the edges of the metering inlet channels intersect each other and open a variable cross-section. The ratio of wetted perimeter to the diameter of the inscribed circle from the idling position to at least the partial load position, is substantially constant when one-third of the maximum cross-section is opened. The ratio does not exceed 6.0 and is measured in the plane of the cross-section.

9 Claims, 5 Drawing Figures

FUEL QUANTITY DISTRIBUTOR FOR MULTICYLINDER COMBUSTION ENGINE

BACKGROUND OF THE INVENTION

The present invention concerns a fuel quantity distributor for multicylinder combustion engines with two concentric, radially adjacent metering elements provided with metering inlet channels and rotatable relative to one another. The edges of the metering inlet channels intersect each other and open a variable cross-section.

Heretofore, in the art, boreholes and slots serve as metering inlet channels. Overlapping drillholes, when slightly opened, constitute a rhombus-like slot which becomes progressively wider and with full opening assumes circular shape. Overlapping slots or slots controlled by the degree of overlap of rectangular cross-section vary mainly or exclusively only in one dimension.

Such fuel quantity distributors can be adjusted accurately in the region from the idling position to the partial load position, when one-third of the maximum cross-section is open, only for a fixed fuel temperature. At other fuel temperatures and hence other fuel viscosities, irregular deviations occur. They are caused by the fact that in the plane of the cross-section, the ratio of wetted perimeter to the diameter of the inscribed circle in the stated regulating range varies appreciably. With a small opening, i.e., in the idling position, the resulting slot-shaped cross-section is particularly unfavorable during viscosity variations.

Accordingly, it is an object of the present invention to provide a distributor arrangement which avoids the above-mentioned disadvantages and protects the fuel quantity distribution to the individual combustion chambers of the combustion engine from the ill effects of varying fuel viscosity.

Another object of the present invention is to provide a distributor arrangement of the foregoing character which is simple in design and construction, and may be easily fabricated.

A further object of the present invention is to provide a distributor arrangement, as described, in which the component parts are readily accessible for servicing, and the distributor arrangement has a substantially long operating life.

SUMMARY OF THE INVENTION

The objects of the present invention are achieved by providing that in the plane of the entry cross-section, the ratio of wetted perimeter of the diameter of the inscribed circle from the idling position to at least the partial load position, is nearly constant and does not exceed 6.0, when one-third of the maximum entry cross-section is open.

This assures that already in the critical region of the idling position, an opening cross-section is present which does not deviate too much from the circular shape considered particularly favorable.

The upper boundary of the metering inlet channels of the outer metering element is provided with a spacer ring. This shape of the metering inlet channels is favorable from the manufacturing viewpoint. It permits the simultaneous machining of both metering elements in one operation, and provides identical contours at the point of overlap.

It is advantageous for the side walls of the metering inlet channels, when viewed at right angles to their longitudinal direction, to subtend an angle of no less than 30° and no more than 60°. The angle is made preferably 60°.

In a further embodiment of the invention, the metering inlet channels of the metering elements are triangular, trapezoid-edged, cylinder segment or cylinder section shaped grooves or combinations of these shapes. The shapes mentioned can be machined with particular ease and the above-mentioned dimensioning rules can be satisfied by the grooves thus formed.

The advantages of the present invention are that even in those metering ranges where only small opening cross-sections are present, these opening cross-sections have a shape which is not too far removed from the circular shape. Thus, at least up to the partial load position where one-third of the maximum entry cross-section is open, this cross-section shape does not vary appreciably. As a result, in case of varying fuel viscosity, no troublesome nonuniform deviations or fuel metering deviations arise.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
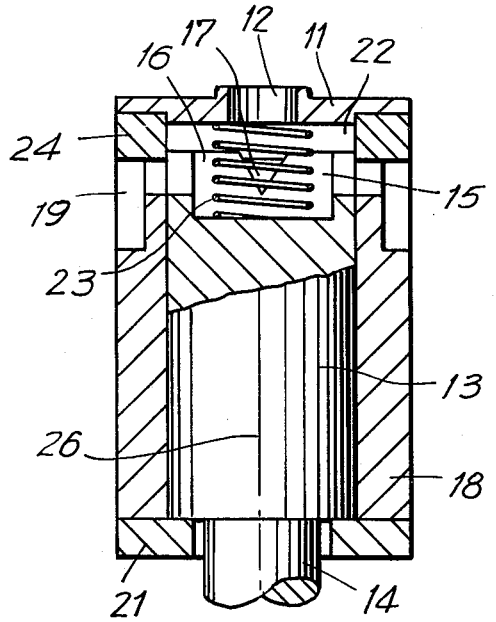
FIG. 1 is a sectional elevational view of the distributor arrangement, in accordance with the present invention.

The present invention as shown in the drawing, has an essentially cylindrical metering element 13 which has a shaft butt 14 and a central borehole 15, forming a cylindrical shell 16. The latter has four metering channels uniformly distributed over the periphery. One of these is designated by 17.

The metering element 13 is located concentrically in a tubelike metering element 18 and can be rotated. Metering element 18 has four exit openings uniformly distributed over the periphery. One of these is designated by 19. Also, in the area of the exit openings, metering element 18 has four inlet channels. One of these is designated by 20.

A bearing retainer 21 is screw-fastened from below to metering element 18. It serves as bottom retainer for metering element 13. On top, the metering element 18, with spacer ring 24, is closed by the thread-fastened cover 11. It contains the fuel inlet hole 12 through which the fuel may enter space 22. Space 22 contains pressure spring 23 which takes care that the bottom surface of metering element 13 is always flush with bearing retainer 21.

Figure 4:
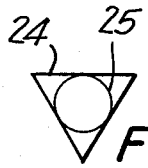
FIG. 4 is a diagrammatical view and shows the cross-sectional shape of the metering inlet channels of the arrangement, in accordance with the present invention.
Figure 2:
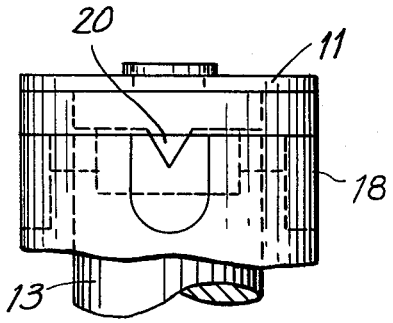
FIG. 2 is a sectional side view of the arrangement of FIG. 1.

The cross-sectional shape of the metering inlet channels 17 and 20 is shown in FIG. 4. The wetted perimeter is designated 24 and the inscribed circle is designated 25.

Figure 5:
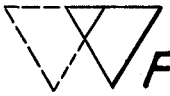
FIG. 5 is a diagrammatic view and shows how the cross-section varies when the metering elements are rotated about an axis relative to each other.
Figure 3:
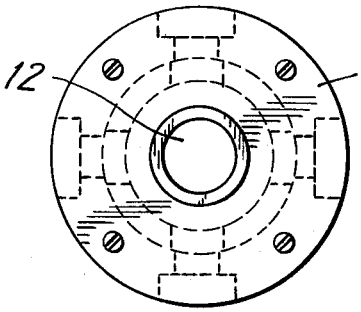
FIG. 3 is a top view of the fuel quantity distributor of FIG. 1.

FIG. 5 shows how the cross-section varies when the metering elements 13 and 18 are rotated about the axis relative to each other.

The finishing of the metering inlet channels is done in the following manner. With parts 11, 23 and 24 not yet assembled and with parts 13 and 18 secured against rotation, at one time two facing grooves are slotted in the metering elements 13 and 18 in one operation. With the four outlet openings shown, it is advantageous to do it in two operations.

Without further analysis the foregoing will so fully reveal the gist of the present invention that others can, by applying current knowledge readily adapted for various applications without omitting features that from the standpoint of prior art, fairly constitute essential characteristics of the generic or specific aspects of this invention, and therefore, such adaptations should and are intended to be comprehended within the meaning and range of equivalence of the following claims.

We claim:

1. A fuel quantity distributor for multicylinder combustion engines comprising, in combination, two concentric, radially adjacent metering elements having metering inlet channels and being rotatable relative to one another, the edges of the metering inlet channels intersecting each other and opening a variable non-rectangular cross-section, the ratio of wetted perimeter to the diameter of the inscribed circle from the idling position to at least the partial load position being substantially constant when one-third of the maximum cross-section is open, said ratio being substantially less than 6.0, said ratio being measured in the plane of said cross-section, and a spacer ring on the upper boundary of said metering inlet channels of the outer one of said metering elements.

2. The fuel quantity distributor as defined in claim 1 wherein the side walls of said metering inlet channels subtend an angle of substantially from 30° to 80°, when viewed normal to their longitudinal direction.

3. The fuel quantity distributor as defined in claim 2 wherein said subtended angle comprises substantially 60°.

4. The fuel quantity distributor as defined in claim 1 wherein the side walls of said metering inlet channels subtend an angle of substantially from 30° to 80° when viewed normal to their longitudinal direction.

5. The fuel quantity distributor as defined in claim 4 wherein said subtended angle comprises substantially 60°.

6. The fuel quantity distributor as defined in claim 1 wherein said metering inlet channels of said metering elements have a triangular shape.

7. The fuel quantity distributor as defined in claim 1 wherein said metering inlet channels of said metering elements comprise substantially cylindrical segment means.

8. The fuel quantity distributor as defined in claim 1 wherein said metering inlet channels of said metering elements comprise cylindrical sectors.

9. The fuel quantity distributor as defined in claim 1 wherein said metering inlet channels of said metering elements are comprised substantially of grooves of predetermined shape.

* * * * *